United States Patent [19]

Lantz

[11] Patent Number: 4,684,125

[45] Date of Patent: Aug. 4, 1987

[54] MUSCLE BUILDING APPARATUS

[76] Inventor: Ingvar Lantz, Fregattvägen 68, S-117 48 Stockholm, Sweden

[21] Appl. No.: 645,816

[22] PCT Filed: Dec. 6, 1983

[86] PCT No.: PCT/SE83/00430

§ 371 Date: Aug. 23, 1984

§ 102(e) Date: Aug. 23, 1984

[87] PCT Pub. No.: WO84/02659

PCT Pub. Date: Jul. 19, 1984

[51] Int. Cl.[4] ..... A63B 21/00; A63B 5/00

[52] U.S. Cl. ..... 272/130; 272/67; 272/72; 272/DIG. 4

[58] Field of Search ..... 272/116, 130, 134, 142, 272/901, 141, 122–125, 93, 72, DIG. 4, 67; 128/25 B

[56] References Cited

U.S. PATENT DOCUMENTS

| | | | |
|---|---|---|---|
| D. 230,613 | 3/1974 | Coker et al. | 272/130 |
| 3,638,941 | 2/1972 | Kulkens | 272/130 |
| 3,861,677 | 1/1975 | Wheeldon | 272/130 |
| 3,948,513 | 4/1976 | Pfotenhauer | 272/134 |
| 4,129,297 | 12/1978 | Dolan | 272/142 X |
| 4,231,568 | 11/1980 | Riley et al. | 272/143 X |
| 4,254,950 | 3/1981 | Baumann | 272/130 |
| 4,257,593 | 3/1981 | Keiser | 272/143 X |
| 4,397,462 | 8/1983 | Wilmarth | 272/130 |
| 4,426,077 | 1/1984 | Becker | 272/130 X |
| 4,477,071 | 10/1984 | Brown et al. | 272/72 |

*Primary Examiner*—Richard J. Apley
*Assistant Examiner*—S. R. Crow

[57] ABSTRACT

A muscle training apparatus comprising a force arm (1) which is rotatably mounted in a carrier (2) and which cooperates with a simple acting or double acting force applying means, especially a gas spring (8) which with one end is rotatably mounted in a bracket (7) of a lever arm (4) included in the force arm, and which with the opposite end is adapted for being mounted in an optional position in the carrier (2) on different distances from the axis of rotation (5) of said lever arm. The force arm (1) is adapted to quickly and easily be rotated from traction operation to pressure operation and vice versa and in an optional position on a support (3). Two or more force arms (1) can be mounted on one and the same support (3) for combined traction or pressure actuation in many different alternative embodiments.

9 Claims, 9 Drawing Figures

MUSCLE BUILDING APPARATUS

The present invention generally relates to a muscle building apparatus by means of which the different muscles of the body may be trained and built up. Previously known muscle building apparatus generally have been formed as training devices operating over weight loads or springs.

The weight load training devices may be disc loading bar bells or dumb bells of different weights which are lifted in different ways. The weight training devices also may be load variable or formed so as to be loaded with different large weights and so that the devices may be handled by the training person standing, lying or in any other position for training of the different types of muscles.

The load training apparatus are disadvantageous from several respects. In most cases the apparatus are formed so that the weights give a constant load both in lifting position and in lowering position. The muscles of the body, on the contrary, have different power ability in the hand, the arm, the leg or any other part of the body depending on the fact, that body lever arm varies during the load lifting work. Therefore the muscle in most load lifting work is loaded by a relatively higher force at the beginning and at the end of the force application than at the mid portion of the load lifting movement. This may cause over-strain and may hurt the training person. Further the muscles must operate with practically the same force during the lowering of the weights. The most serious disadvantage in the weight load training apparatus, however, is the risk that the training person is hurt if he or she lets the weight go, possibly because the weight slips or slides but also if the training person cannot manage to hold the weight. Weight training apparatus generally is also noisy and rattles.

The spring training apparatus to some extent is disadvantageous from the same viewpoint as the weight training apparatus. Springs which may be tension springs, pressure springs, rubber springs or similar springs give a constant force and therefore generally load the muscle with a relatively higher force at the beginning and at the end of the force application of the training person than at more central parts of the force operating movement. Also the springs load the muscle with substantially the same strong force when returning to the initial position, and also in spring apparatus there is a risk that the training person is hurt when he or she slips or cannot restrain the spring. Further, some weight training apparatus or spring training apparatus are formed for a constant load and therefore are suited only for some persons. For a progressive training of muscles it therefore may be necessary to provide a large number of training apparatus for different loads. Also most of the previously known apparatus are formed for training only of special muscles, for instance the arm muscles or the leg muscles or the back muscles. For an overall training, for instant in a training institute, in hospitals, in medical gynmastic institutions etc there may be a need for a large number of different training apparatus to meet normal training needs.

The object of the invention therefore is to solve the problem of providing a simple and overall useful muscle building apparatus which occupies a small space, which is formed so that there only is a very little risk, if any, to hurt the training person, which operates silently, which is formed isokinetically, which can be adjusted for different forces or types of actuation and which can be combined and varied within very wide ranges for practically any type of muscle training.

According to the invention the muscle building apparatus comprises a lever arm, which is rotatably mounted in a carrier and which is connected to a single acting or double acting spring means, especially a gas spring means, and which readily can be adjusted for different forces and different directed force actuation. In a special embodiment of the invention the upper part of the gas spring is connected to the lever arm whereas the opposite end of the gas spring is adapted to be connected to the carrier at different distances from the point of rotation of the lever arm, so that the actuation arm of the gas spring in relation to the lever arm is larger or smaller and so that the entire apparatus readily and easily can be adjusted for higher and lower force actuation respectively.

In a further special embodiment of the invention the axis of rotation of the lever arm and the connection shaft of the gas spring in the carrier are provided such that the moment arm of the gas spring to the lever arm from the beginning of the force actuation progressively increases to a maximum and thereafter decreases, whereupon the actuation force correspondingly increases to a maximum and thereafter decreases during the training movement in a way which is similar to the force curve of the muscle contraction.

The muscle building apparatus according to the invention is designed so that it quickly and easily may be reversed in order to use it either for tensioning actuation or compression actuation. Alternatively it may also be designed with double acting or double gas springs for oppositely directed force actuation. The apparatus also is designed so that it may be mounted vertically, or in any other direction for training of different muscles or muscle combinations, and the apparatus also is designed so that two or more muscle building units may be mounted together for combined training of several muscles or muscle groups.

In the following, the invention will be described more in detail with reference to the accompanying drawings which illustrate different embodiments of the invention.

In the drawings:

FIG. 1 diagrammatically and in a perspective view shows a muscle building apparatus according to the invention.

Figure 7:
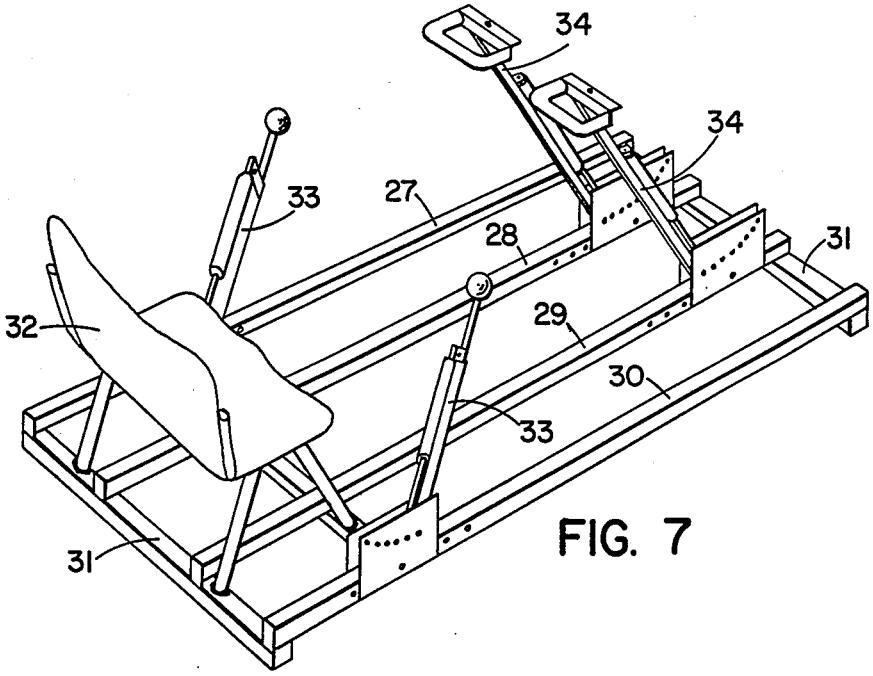

FIGS. 6*a–f* show six different simple alternative combinations and applications of the muscle building apparatus according to the invention; and FIG. 7 shows a four-fold combination of the muscle building apparatus.

Figure 8:
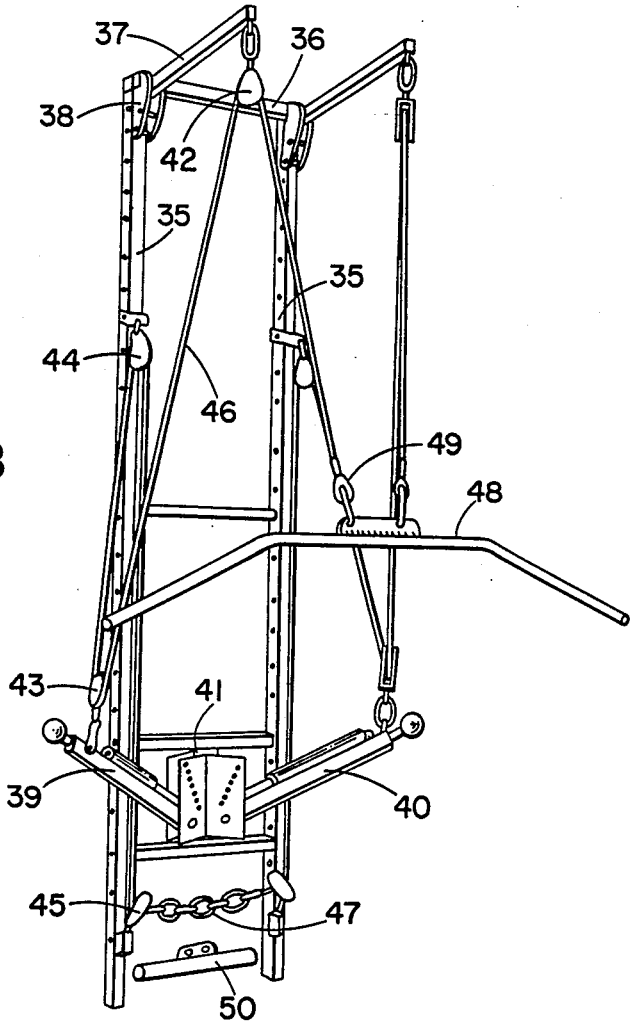
Figure 9:
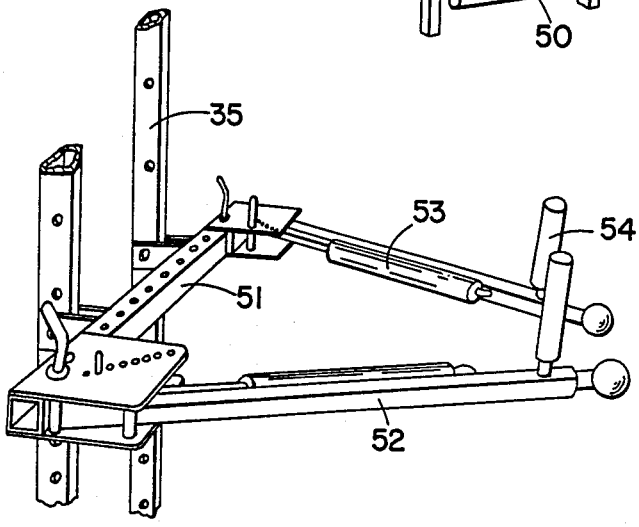

FIG. 8 shows a combination of the apparatus according to the invention especially suited as a latissimus training apparatus and an armcurl and biceps training apparatus, FIG. 9 shows a further combination of the apparatus according to the invention especially suited for training the shoulder muscles, the forearm muscles and the chest muscles.

Figure 1:
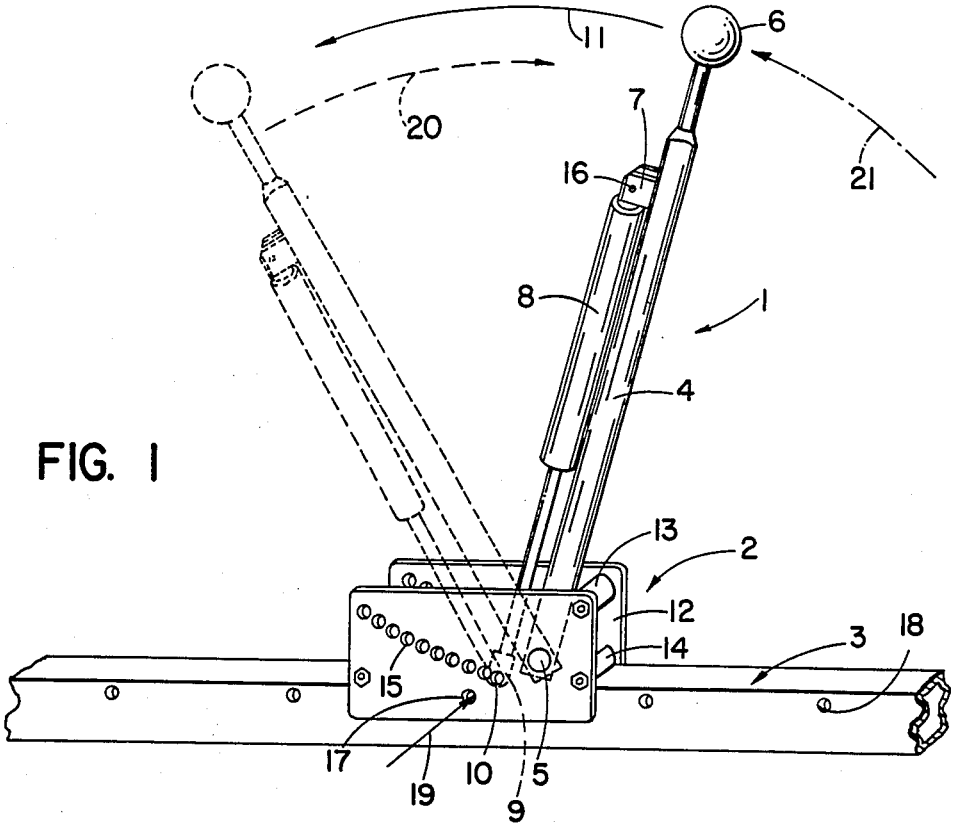

The muscle building apparatus shown in FIG. 1 generally comprises a force reaction arm 1 which is rotatably mounted in a carrier 2, which in turn is adapted to be mounted in a support 3 of any suitable kind.

The force reaction arm 1 comprises a lever arm 4 which is rotatably or pivotally mounted on a shaft 5 in the carrier 2 and which is formed with an actuation means 6, for instance an actuation ball, a handle, a foot connection means, a wire connection means etc.

For providing the reaction force the lever arm 4 carries a bracket 7 for a force reaction means 8, in particular a gas spring, provided at or adjacent the upper end of the lever arm. One end of the gas spring is rotatably mounted in the bracket 7 of the lever arm, and the opposite end 9 of the gas spring is adapted to be mounted in an optional position in the carrier 2 by means of a cross pin 10.

Preferably the gas spring 8 is of the single acting type and is mounted for a force actuation in the direction indicated with the arrow 11 of FIG. 1 but it may as well be formed double acting for a force actuation in both directions. The apparatus also may be formed with two gas springs mounted on each side of the lever arm 4 in the direction of rotation of said lever arm.

In the illustrated case, the carrier 2 comprises two carrier plates 12 which are kept at a predetermined mutual distance by upper cross bolts 13 and lower cross bolts 14. The upper cross bolt or bolts 13 also provide a stop shoulder at least for the return movement of the force reaction arm 1, and the lower cross bolts 14 provide support points for the carrier 2 in relation to the support 3. The carrier plates 12 are formed with a series of cross bores 15 which preferably are located on a common arc centered at the pivoted end 16 of the gas spring 8 at a given position of the reaction arm 1. The cross bore 15 located closest to the lever arm 4 preferably is provided on a level below the line perpendicular to the lever arm 4 at the rotation shaft 5 in the starting position of the lever arm 4, and thereby the cross bores 15 become located progressively closer to the said perpendicular line at locations more remote from the shaft 5. For mounting of the carrier 2 and thereby the force reaction arm 8 in the support 3 the carrier plates 2 are formed with a cross bore 17, and the support is formed with one or more corresponding cross bores 18 so that the carrier by means of a pin 19 can be attached to said support.

In the illustrated case the support 3 is a square bar the width of which substantially corresponds to the distance between the carrier plates 12, and in which the cross bores 18 are provided in such position that the carrier over the cross bolts 14 contact the support 3 without play when the cross pin 19 is inserted through the bores 17 and 18.

When actuating the lever arm 4 in the direction along the arrow 11 the gas spring 8 gives the lever arm a counter force which progressively increases to a maximum and thereafter decreases. One special function of the gas spring is to provide a damped return of the lever arm so that the lever arm simply may be released in the end or return position shown with the dotted line, whereupon the lever arm quietly and safely returns to the initial position following the direction of the dotted arrow 20. Therefore the apparatus operates quietly and safely, and the handle 6 can be released anywhere without the risk that the training person is hurt.

As will be explained in the following the force reaction arm 1 together with the carrier 2 can easily be reversed or turned around on the support 3 from the tension or traction position illustrated with the full line arrow 11 of FIG. 1 to a compression position, whereby the force actuation is made along the phantom arrow 21.

Figure 2:
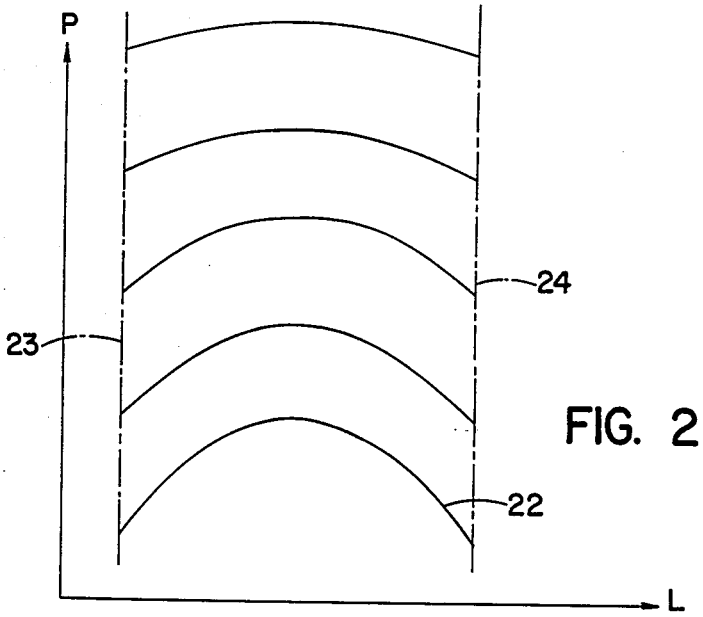
FIG. 2 shows a number of curves over the force actuation of the apparatus according to FIG. 1.

FIG. 2 shows a force reaction curved of the apparatus according to the invention. The length L of the actuation movement has been plotted along the horizontal axis and the variation of the reaction force P over the said actuation movement length has been plotted along the vertical axis. The lower most curve 22 of the number of curves corresponds to the position shown in FIG. 1, in which the gas spring 8 is mounted in the position closest to the lever arm and in which the actuation arm of the gas spring perpendicularly to the longitudinal axis of the lever arm gives a reduced value. Thereby the force P has a relatively low value at the beginning of the movement whereupon the force progressively increases to a maximum substantially intermediate the initial position 23 and the end position 24, whereafter the force P decreases depending on the fact that the force actuation arm of the gas spring 8 in relation to the lever arm 4 decreases.

The curves marked over the above mentioned curve 22 correspond to cases in which the lower end 9 of the gas spring 8 is mounted at greater distances from the rotation shaft 5 of the lever arm 4. It is obvious that the change in force from the start to the return positions decreases following the increase of distance between the rotation shaft 5 of the lever arm 4 on one hand and the mounting position in respective bores 15 of the gas spring on the other hand.

Depending on the location of the bores 15 in relation to the shaft of rotation 5, many different special reaction force functions can be obtained, and it is possible to form the holder plates 12 with a large number or series of bores for providing different specific force functions.

Figure 3:
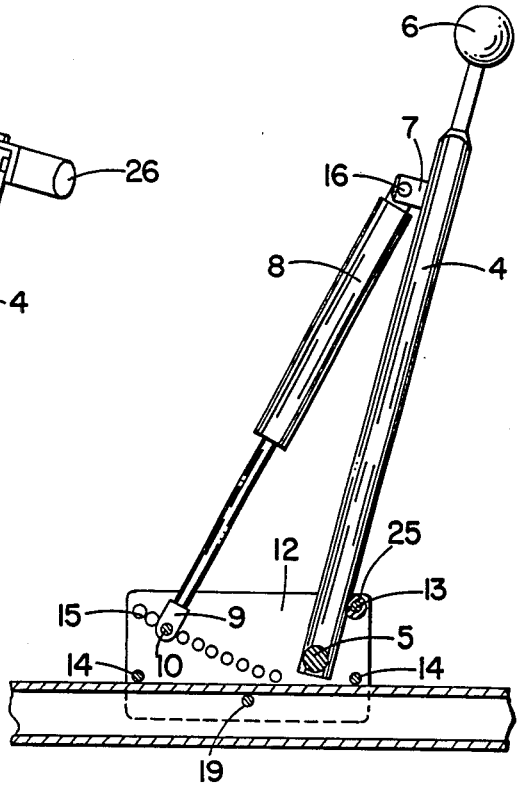
FIG. 3 shows the muscle building apparatus according to FIG. 1 in a partly broken up view and with the spring means in a different position.

FIG. 3 shows the lever arm 4 in the initial or starting position in contact with the upper cross bolt 13, which in this case has a rubber bushing 25. Further, in FIG. 3, the gas spring 8 has with the cross pin 10 been mounted in a position a substantial distance from the axis of rotation 5 of the lever arm 4.

Figure 4:
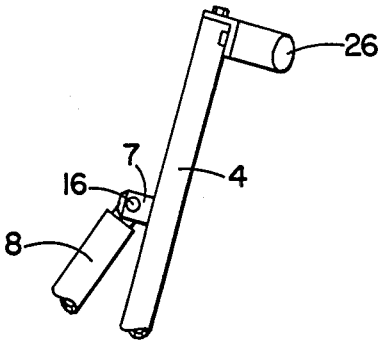
FIG. 4 shows a part of a modified muscle.

FIG. 4 shows an apparatus in which the actuation means is a type of handle 26 suited for introducing a foot for compression actuation of the lever arm 4. Alternatively the handle 26 may be mounted on the opposite side of the lever arm and may be used for traction actuation, whereby the handle 26 is seized by the hand or foot.

Figure 5:
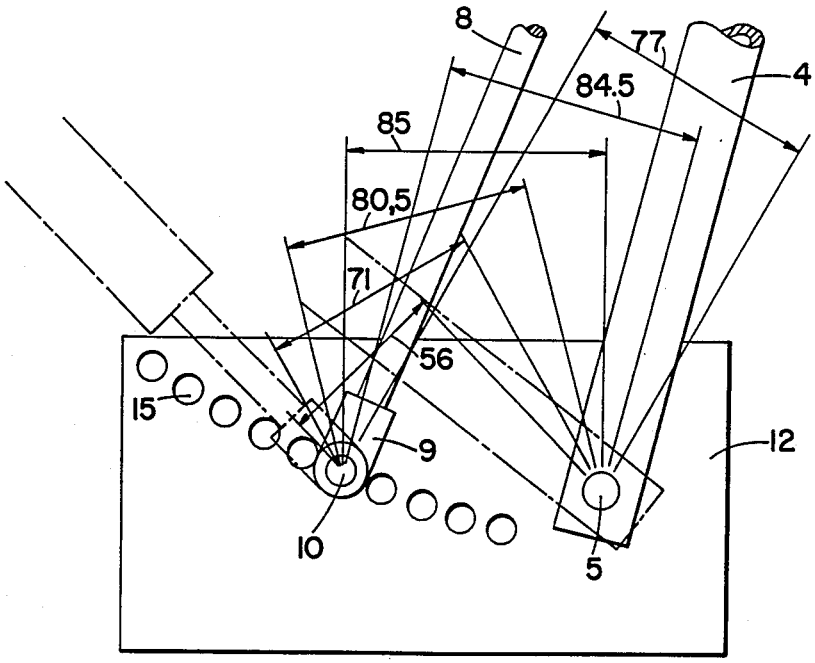
FIG. 5 shows the change of the actuation arm of the force actuating means during a force actuation movement.
Figure 6A:
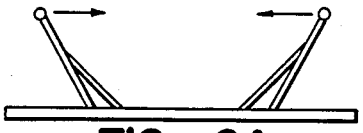
Figure 6B:
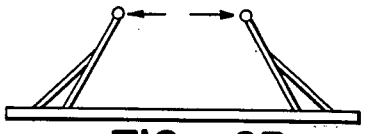
Figure 6C:
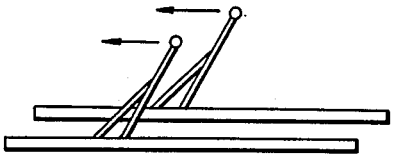
Figure 6D:
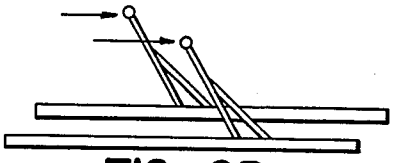
Figure 6E:
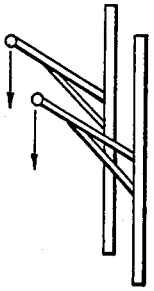
Figure 6F:
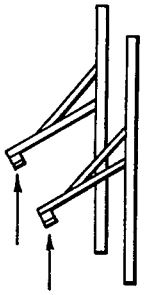

A specific embodiment of the invention is shown in FIG. 5, in which the force arm of the gas spring varies from a non-actuated or starting position having the normal lever arm of 77 mm up to a maximum of 85 mm, whereupon the lever arm decreases to a minimum of 56 mm. Correspondingly the force by which the lever arm must be actuated for rotating the lever arm consequently varies. It is obvious that the reaction force, of course, also may be varied by exchanging the gas spring for a stronger or weaker gas spring, and that it is possible to obtain pressures between for instance 10 and 200 kg with the same design of the apparatus, and that the apparatus therefore can be used by any person and in practically any field of use.

FIG. 6 illustrates some possible combination applications for the invention. FIG. 6*a* shows two force packs adapted to be pulled toward each other, FIG. 6*b* shows two force packs adapted to be pushed apart, FIG. 6*c* shows two parallel mounted force packs intended for traction training, and FIG. 6*d* shows two parallel mounted force packs intended for pushing training. FIG. 6*e* shows the apparatus mounted vertically, in this case for traction in the downward direction, and FIG. 6*f* correspondingly shows two vertically oriented and parallel-mounted devices for compression training in the vertical direction. By different mounting and different combination the apparatus may separately or in combinations permit a large number of exercises, for instance traction or compression exercises for biceps and triceps; armcurls, lifting with biceps; exercises placing shoulder and chest muscles in traction and compression; shoulder compression and traction; latissimus traction; bench and leg presses; combinations of leg compression and arm traction; and many different special combinations, for instance for runners, skiers, rowers etc.

FIG. 7 shows a non-limited special example of an apparatus for trainingarower and thereby for training the arm muscles, the leg muscles and the back muscles and several other muscles. In this case the support comprises four parallel mounted bars 27–30 mounted on a number of cross bars 31. On some of the cross bars a chair 32 is mounted on which the training person sits during the training. On the outer longitudinal bars 27 and 30 two traction force packs 33 have been mounted and adapted to be seized by the hands, and on the intermediate longitudinal bars 28 and 29 two pressure force packs 34 have been mounted and adapted to be actuated by pressure by the legs. The apparatus is used for combined training and provides the muscle training which is obtained when rowing a boat.

FIG. 8 shows a lift-type training apparatus comprising two support bars 35 which are mounted vertically on a wall or which may be provided with means for temporarily mounting the entire apparatus on wall bars or similar means in a training institute. The support bars 35 are interconnected by a number of cross bars 36. A boom means comprising two horizontally extending boom bars 37 and a holder 38 thereof are adapted to be mounted in any suitable position along the vertical support bars 35. Adjacent the lower end of the support bars two force packs 39 and 40 are mounted rotatable around a vertical support bar 41. The two force packs 39 and 40 in this case are mounted for a training action in the upward direction, but it is obvious to the expert that the force packs may be mounted oppositely viz. for actuation in the downward direction.

For the training activity there is a wire-pulley system, which gives a large number of training possibilities. The apparatus includes a pulley 42 at the outer end of the boom bars 37, a pulley 43 at the outer end of each force pack 39 and 40, one or more pulleys 44 intermediate the bottom and the top ends of the support bars 35 and a pulley 45 adjacent the bottom of the support bars 35. The pulleys and the force packs are interconnected by wires 46 for transmitting the force between the training person and the force packs. In the illustrated case the apparatus is prepared for latissimus training, whereby the two wires 46 are interconnected at 47 and each extends from the pulley 45 through pulleys, 44, 43 and 42 and are interconnected by a latissimus traction bar 48. The traction bar 48 is actuated in the downward direction.

Alternatively the apparatus according to FIG. 8 may be prepared for armcurl training, and in that case ends 49 of the wires 46 are interconnected, and the ends 47 of the wires are connected at the lower end of the apparatus to the arm curl bar 50, whereby the force packs 39 and 40 are actuated by lifting the armcurl bar 50 in the upward direction.

The wire may be connected to the outer end of each force pack 39 or 40 and extend through the pulley 44.

It is obvious to the expert that a large number of different training activities may be accomplished by the illustrated device by changing the position of the wire or wires and/or turning the power packs 39 and 40 upside down as compared with the position illustrated in FIG. 8.

Of course the power packs 39 and 40 also may be mounted directly to the support bars 35 as illustrated in FIG. 1, whereby the force packs may be used for direct traction or pressure training with the training person standing up, on his knees, lying down on his back or in any other position.

FIG. 9 shows an apparatus especially suited for training the forearm muscles and the chest muscles and which comprises a horizontal support bar 51 having brackets 52 for mounting of the bar in any vertical position along the vertical support bars 35, preferably on a level substantially equivalent to the waist of the training person. The horizontal bar 51 is identical to the vertical support bars 35, so that one or more force packs 52, 53 can be mounted in any desired position thereon. FIG. 9 illustrates an application in which the force packs 52 and 53 are mounted at the end of the horizontal bar 51 and in a position to actuate the force packs in the direction towards each other. Obviously the force packs may be mounted oppositely, viz. in a position to actuate the force packs in a direction apart from each other. The training person may be standing in front of the two force packs to seize the balls by the hands, or he or she may stand between the two force packs, and for this purpose the lever arm 4 is preferably provided with vertical handles 54 to be seized by the hands of the training person. It is obvious to the expert that the apparatus may be prepared for a further large number of applications and combinations within the scope of the appended claims and within the basic idea of the invention.

I claim:

1. Muscle building apparatus comprising:

an integral power pack including a carrier, a force reaction arm (1) pivotally mounted at one end (5) in the carrier (2) for movement back and forth between a starting position and a return position, and elongated gas spring means (8), the gas spring means (8) also being pivotally mounted at one end (9) to the carrier (2) and pivotally connected at the opposite end (16) with the force reaction arm (1) at a position remote from the carrier (2), the force reaction arm (1) and the elongated gas spring means (8) being mounted on the carrier to assume substantially parallel relationship at the return position, with cross bores located on the carrier between the arm and the spring means at mounting points, each bore providing a moment arm variable with the reaction arm movement between the starting and the return position, the moment arm reaching a maximum at a position of the force reaction arm intermediate the starting and return positions, said cross bores enabling the setting of different reaction force functions, and an elongated support bar (3) having selectable mounting positions along the bar for mounting said power pack including the carrier, the force reaction arm, and the gas spring means for movement of the arm back and forth in opposite directions at each mounting position.

2. Muscle building apparatus according to claim 1, wherein the carrier (2) is formed with several cross bores (15) provided at different distances from the pivoted end (5) of the force reaction arm (4), and the pivoted end (9) of the gas spring means (8) is adapted for mounting optionally in any of said cross bores (15), thereby providing different force moment arms between the force reaction arm (1) and the springs means (8).

3. Muscle building apparatus according to claim 2, wherein the cross bores (15) for mounting of the gas spring means (8) in the carrier (2) are provided on a common arc centered at said opposite end (16) of the spring means (8) at a given position of the force reaction arm (1).

4. Muscle building apparatus according to claim 2 wherein at least the cross bore (15) of the carrier (2) provided closest to the force reaction arm is located more distantly from the pivotal connection between the gas spring means and reaction arm than the pivotal mounting point of the arm when the arm is in the starting position.

5. Muscle building apparatus according to claim 1 wherein the carrier (2) includes two interconnected carrier plates (12) adapted for mounting on the support bar (3) and a cross pin (19) for holding the plates to the support bar whereby the carrier (2) together with the force reaction arm (4) and the gas spring means (8) can quickly and easily be reversed for traction or compression actuation.

6. Muscle building apparatus according to claim 1 wherein actuation means for engagement by the body of the training person is connected with the force reaction arm (1) at the end remote from the carrier.

7. Muscle building apparatus according to claim 1 wherein the apparatus includes a combination of two or more power packs (33,34,39,40,52,53) provided for traction or compression actuation and mounted on the support bar (3).

8. Muscle building apparatus according to claim 7 wherein the support bar (41) is vertically oriented and the apparatus comprises two power packs (39,40), which are mounted rotatably on the vertically oriented support bar (41), a system of at least two pulleys (43–45) fixedly positioned with respect to the support bar (41)

attached to the force reaction arms of the power packs and extending over the pulleys to be pulled by the training person.

9. Apparatus according to claim 7 wherein the apparatus comprises a horizontal support bar (51) which is mounted in any suitable position along vertically mounted bars (35), and which carries two power packs (52,53) mounted for simultaneous force actuation by the training person.

* * * * *